US012692454B2

(12) United States Patent
Kawanoue et al.

(10) Patent No.: US 12,692,454 B2
(45) Date of Patent: Jul. 28, 2026

(54) GREASE COMPOSITION FOR CONSTANT-VELOCITY JOINT AND CONSTANT-VELOCITY JOINT FILLED THEREWITH

(71) Applicants: KYODO YUSHI CO., LTD., Fujisawa (JP); NTN CORPORATION, Osaka (JP)

(72) Inventors: Zen Kawanoue, Kameyama (JP); Shin Ogasawara, Yamato (JP); Haruna Omi, Kawasaki (JP); Manabu Shintani, Fujisawa (JP); Hiroshi Murakami, Iwata (JP); Mika Kohara, Iwata (JP); Rina Kondo, Iwata (JP)

(73) Assignees: KYODO YUSHI CO., LTD., Kanagawa (JP); NTN CORPORATION, Osaka (JP)

( * ) Notice: Subject to any disclaimer, the term of this patent is extended or adjusted under 35 U.S.C. 154(b) by 0 days.

(21) Appl. No.: 18/866,269

(22) PCT Filed: May 15, 2023

(86) PCT No.: PCT/JP2023/018130
§ 371 (c)(1),
(2) Date: Nov. 15, 2024

(87) PCT Pub. No.: WO2023/224006
PCT Pub. Date: Nov. 23, 2023

(65) Prior Publication Data

US 2025/0354080 A1 Nov. 20, 2025

(30) Foreign Application Priority Data

May 16, 2022 (JP) ..... 2022-079995

(51) Int. Cl.

| | |
|---|---|
| ***C10M 111/06*** | (2006.01) |
| ***C10M 141/12*** | (2006.01) |
| *C10N 10/04* | (2006.01) |
| *C10N 10/12* | (2006.01) |

(52) U.S. Cl.
CPC ..... *C10M 111/06* (2013.01); *C10M 141/12* (2013.01); *C10M 2215/0813* (2013.01);
(Continued)

(58) Field of Classification Search
CPC ..... C10M 111/06; C10M 141/12; C10M 2215/0813; C10M 2219/104; C10N 2010/04; C10N 2010/12
See application file for complete search history.

(56) References Cited

U.S. PATENT DOCUMENTS 5,160,645 A * 11/1992 Okaniwa ..... C10M 137/10 508/552
5,952,273 A 9/1999 Suzuki et al.
(Continued)

FOREIGN PATENT DOCUMENTS

JP H10273692 A 10/1998
JP 2001520301 A 10/2001
(Continued)

OTHER PUBLICATIONS

International Search Report (PCT/ISA/210) and Written Opinion (PCT/ISA/237) issued on Jul. 18, 2023, by the Japan Patent Office in corresponding International Application No. PCT/JP2023/018130, with English translation of the Search Report (12 pages).

*Primary Examiner* — Cephia D Toomer
(74) *Attorney, Agent, or Firm* — Panitch Schwarze Belisario & Nadel LLP

(57) ABSTRACT

A grease composition for a constant-velocity joint includes:
(a) a base oil having a kinematic viscosity of 16.0 $mm^2/s$ or more at 100° C. and a viscosity index of 90 or more;
(Continued)

(b) a diurea-based thickener, for example, an aliphatic diurea;
(c) 0.2 to 2.0% by mass of zinc dialkyldithiophosphate;
(d) 0.5 to 2.0% by mass of non-oil-soluble molybdenum dialkyl dithiocarbamate;
(e) 0.5 to 3.0% by mass of oil-soluble molybdenum dialkyl dithiocarbamate;
(f) 1.0 to 4.0% by mass of zinc dialkyldithiocarbamate; and
(g) 0.1 to 1.5% by mass of a benzothiazole-thione or a derivative thereof, wherein (f):(g)=8:1 to 3:1 (mass ratio).

6 Claims, 1 Drawing Sheet

(52) U.S. Cl.
CPC ... *C10M 2219/104* (2013.01); *C10N 2010/04* (2013.01); *C10N 2010/12* (2013.01)

(56) References Cited

U.S. PATENT DOCUMENTS 6,022,835 A * 2/2000 Fletcher ..... C10M 141/10 508/371
2003/0139302 A1* 7/2003 Akada ..... C10M 169/06 508/567
2005/0003970 A1* 1/2005 Ohmura ..... C10M 169/06 508/379
2007/0179066 A1* 8/2007 Sakamoto ..... C10M 169/02 508/113
2009/0176671 A1 7/2009 Ozaki et al.
2010/0173807 A1 7/2010 Nagumo et al.
2012/0195678 A1 8/2012 Kakizaki et al.
2016/0305488 A1 10/2016 Yoshihara et al.

FOREIGN PATENT DOCUMENTS

| | | | | |
|---|---|---|---|---|
| JP | 2003165988 | A | | 6/2003 |
| JP | 2006283830 | A | | 10/2006 |
| JP | 2007302761 | A | | 11/2007 |
| JP | 4181771 | B2 | * | 11/2008 |
| JP | 2008297402 | A | | 12/2008 |
| JP | 2010090243 | A | | 4/2010 |
| JP | 2011079902 | A | | 4/2011 |
| JP | 2015108067 | A | | 6/2015 |
| JP | 2015160909 | A | | 9/2015 |
| JP | 2016044265 | | * | 4/2016 |
| JP | 2016044265 | A | | 4/2016 |
| WO | 2008146909 | A1 | | 12/2008 |
| WO | 2011142411 | A1 | | 11/2011 |

* cited by examiner

GREASE COMPOSITION FOR CONSTANT-VELOCITY JOINT AND CONSTANT-VELOCITY JOINT FILLED THEREWITH

CROSS-REFERENCE TO RELATED APPLICATIONS

This application is a Section 371 of International Application No. PCT/JP2023/018130, filed May 15, 2023, which was published in the Japanese language on Nov. 23, 2023, under International Publication No. WO 2023/224006 A1, which claims priority under 35 U.S.C. § 119(b) to Japanese Application No. 2022-079995, filed May 16, 2022, the disclosures of which are incorporated herein by reference in their entirety.

TECHNICAL FIELD the present invention relates to a grease composition for a constant-velocity joint and a constant-velocity joint hermetically filled therewith.

BACKGROUND ART

In automobiles, FF vehicles have been widely used from the viewpoint of reductions in weight for the purpose of environmental measures ($CO_2$ reduction) of vehicles and keeping occupational spaces, and constant-velocity joints (CVJs) that are essential for the power transmissions of FF vehicles have been used.

CVJs are devices that transmit rotation between two shafts that rotate with angels, and thus the components go through a complicated rolling sliding motion inside the joints. Among CVJs, a plunging CVJ also has a sliding mechanism in an axial direction, and a sliding resistance in the axial direction is generated by friction between the members inside the joint. If this sliding resistance is large, it would cause vibrations and noise in some cases.

Due to changes in vehicle specifications associated with noise regulations and the demands for improvements of fuel economy of automobiles in recent years, there is a case where a plunging constant-velocity joint is exposed to a high-temperature environment. Hence, there is a demand for durability at a high temperature (anti-flaking properties) and an initial conformability for securing durability. The initial conformability means smoothing waviness or unevenness generated on a surface of the joint by processing of the joint promptly after the start of use of the joint.

As greases for CVJ that are excellent in anti-flaking properties at ordinary temperature, a grease obtained by blending a urea grease with a zinc dialkyldithiophosphate, a molybdenum dialkyl dithiocarbamate, a zinc dialkyldithiophosphate, and a sulfur-nitrogen-based extreme pressure additive (see Patent Literature 1) and a grease obtained by blending a urea grease with a molybdenum disulfide, a molybdenum dialkyl dithiocarbamate, a calcium salt of petroleum sulfonic acid, a sulfur-based extreme pressure agent, a specific vegetable oil or fat, and a zinc dialkyldithiocarbamate (see Patent Literature 2) have been proposed.

On the other hand, as greases that are excellent in wear resistance, a grease obtained by blending a urea grease with benzotriazole and/or a derivative thereof, and a phosphoric acid ester and/or an amine salt thereof has been proposed (see Patent Literature 3), and a grease obtained by blending a lithium soap grease with a stearic acid metallic salt of Ca, Mg, Zn, or the like, a molybdenum dialkyl dithiocarbamate, and a zinc dialkyldithiocarbamate has also been proposed (see Patent Literature 4).

In this way, the durability and wear resistance at ordinary temperature have been studied for grease compositions for CVJs as well; however, it cannot necessarily be said that the durability and initial conformability at a high temperature have been sufficiently studied.

CITATION LIST

Patent Literatures

Patent Literature 1: Japanese Patent Application Publication No. 2008-297402

Patent Literature 2: Japanese Patent Application Publication No. 2010-90243

Patent Literature 3: Japanese Patent Application Publication No. 2015-108067

Patent Literature 4: Japanese Patent Application Publication No. 2011-79902

SUMMARY OF INVENTION

Problems to be Solved by the Invention

Hence, an object of the present invention is to provide a grease composition that is excellent in durability and initial conformability even in a high-temperature environment.

In addition, an object of the present invention is also to provide a constant-velocity joint hermetically filled with the above-described grease composition.

Means for Solution of the Problems

As a result of conducting studies, the present inventors have found that a grease composition using a base oil having specific kinematic viscosity and viscosity index is excellent in durability and initial conformability even at a high temperature. Specifically, the present invention provides a grease composition for a constant-velocity joint and a constant-velocity joint hermetically filled therewith as follows.

1. A grease composition for a constant-velocity joint, comprising:
   (a) a base oil having a kinematic viscosity of 16.0 $mm^2/s$ or more at 100° C. and a viscosity index of 90 or more;
   (b) a diurea-based thickener represented by the following formula (1)

$$R^1NH—CO—NH—C_6H_4—p\text{-}CH_2—C_6H_4—p\text{-}NH—CO—NHR^{1'} \quad (1)$$

wherein $R^1$ and $R^{1'}$ are each independently an octyl group, a dodecyl group, a hexadecyl group, an octadecyl group, or a cyclohexyl group;
   (c) 0.2 to 2.0% by mass of a zinc dialkyldithiophosphate;
   (d) 0.5 to 2.0% by mass of a non-oil-soluble molybdenum dialkyl dithiocarbamate;
   (e) 0.5 to 3.0% by mass of an oil-soluble molybdenum dialkyl dithiocarbamate;
   (f) 1.0 to 4.0% by mass of a zinc dialkyldithiocarbamate; and (g) 0.1 to 1.5% by mass of a benzothiazole-thione or a derivative thereof, wherein a mass ratio between the component (f) and the component (g) is (f):(g)=8:1 to 3:1.

2. The grease composition according to the above 1, wherein the component (c) is represented by the following formula (2):

$$[(R^2O)_2SP—S]_2—Zn \quad (2)$$

wherein $R^2$ is a primary or secondary alkyl group having 1 to 24 carbon atoms.

3. The grease composition according to the above 1 or 2, wherein the component (d) is represented by the following formula (3):

$$[R^{30}{}_2N—CS—S]_2—Mo_2O_mS_n \quad (3)$$

wherein $R^{30}$ is a primary or secondary alkyl group having 1 to 4 carbon atoms, m is 0 to 3, n is 1 to 4, and m+n=4.

4. The grease composition according to any one of the above 1 to 3, wherein the component (e) is represented by the following formula (4):

$$[R^{31}{}_2N—CS—S]_2—Mo_2O_mS_n \quad (4)$$

wherein $R^{31}$ is a primary or secondary alkyl group having 5 to 24 carbon atoms, m is 0 to 3, n is 1 to 4, and m+n=4.

5. The grease composition according to any one of the above 1 to 4, wherein the component (f) is represented by the following formula (5):

$$[R^4{}_2N—CS—S]_2—Zn \quad (5)$$

wherein $R^4$ is a primary or secondary alkyl group having 1 to 24 carbon atoms.

6. A constant-velocity joint hermetically filled with the grease composition for a constant-velocity joint according to any one of the above 1 to 5.

Advantageous Effects of Invention

The grease composition of the present invention is excellent in durability and initial conformability even in a high-temperature environment. In addition, the grease composition of the present invention is also excellent in shear stability. In addition, the grease composition of the present invention is also excellent in vibration resistance.

DESCRIPTION OF EMBODIMENTS (a) Base Oil

Figure 1:
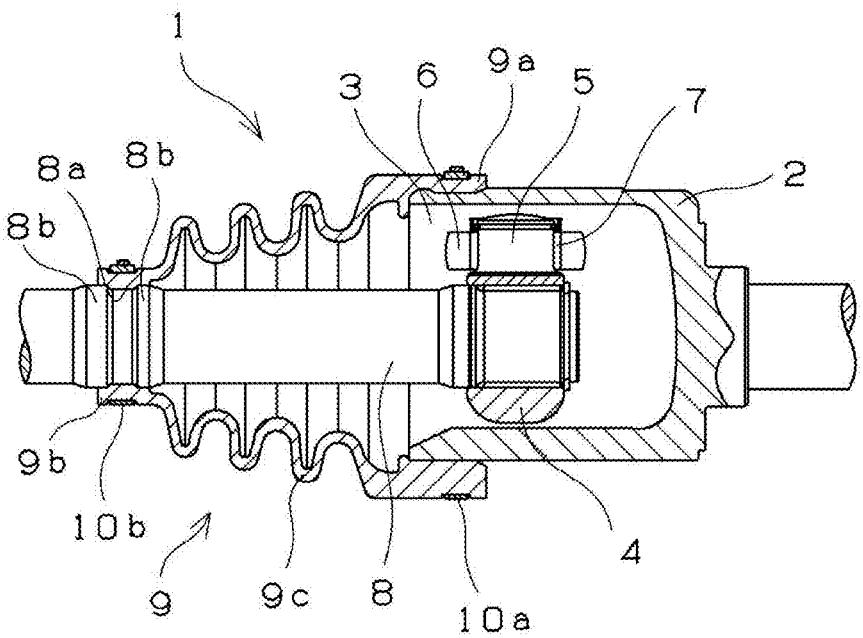
FIG. 1 is a diagram of a tripod joint using a grease composition for a constant-velocity joint of the present invention in which a part thereof is cut out.

A base oil of the present invention has a kinematic viscosity of 16.0 $mm^2/s$ or more at 100° C. and a viscosity index of 90 or more.

When the kinematic viscosity at 100° C. is 16.0 $mm^2/s$ or more, a sufficient oil film thickness can be secured even under a condition of a temperature of the surface of the CVJ of 90 to 100° C., and the lubricity at a high temperature can thus be maintained.

When the viscosity index is 90 or more, vibration can be suppressed by a reduction in sliding resistance at ordinary temperature and a reduction in agitation resistance in a low-temperature environment.

As long as the kinematic viscosity and the viscosity index are within such ranges, the type of base oil used in the present invention is not particularly limited. For example, such base oils include mineral oils represented by a naphthene-based oil and a paraffin-based oil, synthetic hydrocarbon oils represented by polybutene, ether-based synthetic oils represented by alkyl diphenyl ether, and various synthetic oils such as silicone oil and fluorinated oil. The synthetic oil may be a so-called biomass oil produced by using a biological resource produced from an animal, a plants, or the like as a raw material. For example, biomass ester oils synthesized from various fatty acids using vegetable oils as raw materials and alcohols, and biomass hydrocarbon oils using vegetable oils such as palm oil, corn oil, and soybean oil can also be used. One base oil may be used alone, or two or more base oils may be mixed. A mineral oil is preferable from the viewpoint of cost, and a paraffin-based mineral oil is preferable to a naphthene-based oil from the viewpoint of viscosity index.

The kinematic viscosity at 100° C. is preferably 18.0 $mm^2/s$ or more from the viewpoint of securing an oil film thickness at a high temperature. In addition, the kinematic viscosity at 100° C. is preferably 24.0 $mm^2/s$ or less, and more preferably 22.0 $mm^2/s$ or less, from the viewpoint of suppressing vibration at ordinary temperature and reducing an agitation resistance in a low-temperature environment.

The viscosity index is preferably 93 or more from the viewpoint of suppressing vibration at ordinary temperature and reducing an agitation resistance in a low-temperature environment. In addition, the viscosity index is preferably 120 or less, and more preferably 110 or less, from the viewpoint of compatibility with a boot material.

As the base oil of the present invention, a mineral oil having a kinematic viscosity of 18.0 $mm^2/s$ or more at 100° C. and a viscosity index of 95 or more is preferable from the viewpoint of securing an oil film thickness at a high temperature, reducing a sliding resistance at ordinary temperature, and reducing an agitation resistance in a low-temperature environment. A mineral oil having a kinematic viscosity of 19.0 to 20.0 $mm^2/s$ at 100° C. and a viscosity index of 95 to 105 is more preferable.

Note that the kinematic viscosity of the base oil can be measured in accordance with JIS K 2283. The viscosity index of the base oil can be obtained from measured values of the kinematic viscosities at 40° C. and 100° C. of the base oil in accordance with a calculation formula specified in JIS.

The content of the base oil is preferably 80 to 94% by mass, more preferably 83 to 92% by mass, and further preferably 85 to 90% by mass, based on the total mass of the composition, from the viewpoint of the fluidity of the grease.

(b) Thickener

A thickener of the present invention is a diurea-based thickener represented by the following formula (1).

$$R^1NH—CO—NH—C_6H_4—p\text{-}CH_2—C_6H_4—p\text{-}NH—CO—NHR^{1'} \quad (1)$$

wherein $R^1$ and $R^{1'}$ are each independently an octyl group, a dodecyl group, a hexadecyl group, an octadecyl group, or a cyclohexyl group.

The diurea-based thickener of the formula (1) includes an aliphatic diurea in which both $R^1$ and $R^{1'}$ are each an octyl group, a dodecyl group, a hexadecyl group, or an octadecyl group, an alicyclic aliphatic diurea containing a diurea compound in which one of $R^1$ and $R^{1'}$ is an octyl group, a dodecyl group, a hexadecyl group, or an octadecyl group and the other thereof is a cyclohexyl group, and an alicyclic diurea in which both $R^1$ and $R^{1'}$ are each a cyclohexyl group.

The thickener is preferably an aliphatic diurea thickener or an alicyclic aliphatic diurea thickener which is easily softened by shear, and more preferably an alicyclic aliphatic diurea thickener because when the grease easily flows in the CVJ, the grease can be easily supplied to a sliding portion, which leads to an improvement in durability. As the aliphatic diurea thickener, one of $R^1$ and $R^{1'}$ in the formula (1) is preferably an octyl group. The alicyclic aliphatic diurea thickener is preferably a mixture of a diurea compound in which one of $R^1$ and $R^{1'}$ in the formula (1) is an octadecyl group and the other thereof is a cyclohexyl group, a diurea compound in which both $R^1$ and $R^{1'}$ in the formula (1) are each an octadecyl group, and a diurea compound in which both $R^1$ and $R^{1'}$ in the formula (1) are each a cyclohexyl group is preferable. The molar ratio between a cyclohexyl group and an octadecyl group of the alicyclic aliphatic diurea thickener is preferably 1:9 to 3:7, and more preferably 1:9 to 2:8, from the viewpoint of securing the fluidity of the grease.

The content of the thickener may be an amount with which the penetration of the grease can be adjusted to 300 to 350, and specifically, is preferably 3 to 10% by mass, more preferably 4 to 9% by mass, and further preferably 5 to 8% by mass, based on the total mass of the composition. Note that in the Specification, the "penetration" means 60-stroke worked penetration measured in accordance with JIS K 2220.7.

(c) As a Zinc Dialkyldithiophosphate (ZnDTP), One Represented by the Following Formula (2) is Preferable $$[(R^2O)_2SP—S]_2—Zn \quad (2)$$

wherein $R^2$ is a primary or secondary alkyl group having 1 to 24 carbon atoms or aryl group having 6 to 30 carbon atoms. $R^2$ is particularly preferably a primary or secondary alkyl group having 3 to 8 carbon atoms.

The content of the component (c) is 0.2 to 2.0% by mass, preferably 0.5 to 1.8% by mass, and more preferably 0.8 to 1.5% by mass, based on the total mass of the composition. Adding the component (c) in such a range is preferable because sufficient initial conformability can be obtained.

(d) As a Non-Oil-Soluble Molybdenum Dialkyl Dithiocarbamate (Non-Oil-Soluble MoDTC), One Represented by the Following Formula (3) is Preferable $$[R^{30}{}_2N—CS—S]_2—Mo_2O_mS_n \quad (3)$$

wherein $R^{30}$ is a primary or secondary alkyl group having 1 to 4 carbon atoms, and preferably a primary or secondary alkyl group having 2 to 4 carbon atoms, m is 0 to 3, n is 1 to 4, and m+n=4.

The content of the component (d) is 0.5 to 2.0% by mass, preferably 0.5 to 1.5% by mass, and more preferably 0.5 to 1.0% by mass, based on the total mass of the composition, from the viewpoint of low friction properties. Adding the component (d) in such a range is preferable because sufficient low friction properties can be obtained.

(e) As an Oil-Soluble Molybdenum Dialkyl Dithiocarbamate (Oil-Soluble MoDTC), One Represented by the Following Formula (4) is Preferable $$[R^{31}{}_2N—CS—S]_2—Mo_2O_mS_n \quad (4)$$

wherein $R^{31}$ is a primary or secondary alkyl group having 5 to 24 carbon atoms, and preferably a primary or secondary alkyl group having 5 to 18 carbon atoms, m is 0 to 3, n is 1 to 4, and m+n=4.

The content of the component (e) is 0.5 to 3.0% by mass, preferably 0.5 to 2.5% by mass, and more preferably 0.5 to 2.0% by mass, based on the total mass of the composition, from the viewpoint of low friction properties. Adding the component (e) in such a range is preferable because sufficient low friction properties can be obtained.

(f) As a Zinc Dialkyldithiocarbamate (ZnDTC), One Represented by the Following Formula (5) is Preferable $$[R^4{}_2N—CS—S]_2—Zn \quad (5)$$

wherein $R^4$ is a primary or secondary alkyl group having 1 to 24 carbon atoms or aryl group having 6 to 30 carbon atoms. $R^4$ is preferably an alkyl group having 3 to 8 carbon atoms.

The content of the component (f) is 1.0 to 4.0% by mass, preferably 1.2 to 3.8% by mass, and more preferably 1.5 to 3.5% by mass, based on the total mass of the composition, from the viewpoint of initial conformability. Adding the component (f) in such a range is preferable because sufficient initial conformability can be obtained.

(g) A benzothiazole-thione or a derivative thereof is normally used as an extreme pressure agent for a grease. For example, a "compound of amines, C16 to 22-tert-alkyl, and 2 (3H)-benzothiazole-thione (1:1)" (a compound represented by Amines, C16-22-tert-alkyl, compds. with 2 (3H)-benzothiazolethione (1:1)) (for example, Vanlube (registered trademark) 601 produced by Vanderbilt) can be used, and among these, one having a sulfur content of 5 to 20% by mass and a nitrogen content of 1 to 10% by mass is preferable.

The content of the component (g) is 0.1 to 1.5% by mass, preferably 0.2 to 1.2% by mass, and more preferably 0.3 to 1.0% by mass, based on the total mass of the composition, from the viewpoint of initial conformability. Setting the content of the component (g) in such a range is preferable because sufficient initial conformability can be obtained.

The mass ratio between the component (f) and the component (g) is (f):(g)=8:1 to 3:1, and preferably 6:1 to 3.5:1. Setting the mass ratio between the component (f) and the component (g) in such a range is preferable because sufficient initial conformability can be obtained.

The grease composition of the present invention may contain an additive normally used for a grease composition, such as another extreme pressure additive, an antioxidant, or a rust inhibitor in addition to the above-described components. The other extreme pressure additive includes phosphoric acid ester and the like. The antioxidant includes amine-based and phenol-based antioxidants and the like. The rust inhibitor includes sulfonate-based, carboxylic acid-based, and amine-based rust inhibitors. The content of such an optional additive is, for example, 0.1 to 2.0% by mass, and preferably 0.3 to 1.0% by mass based on the total mass of the composition.

The grease composition for a constant-velocity joint of the present invention can be used for any constant-velocity joints without limitation, but the expression of the advantageous effects is particularly significant in the case where the grease composition for a constant-velocity joint of the present invention is used for constant-velocity joints in which components conduct rolling sliding motions, for example, plunging constant-velocity joints such as tripod joints and double-offset joints.

The structures of plunging constant-velocity universal joints preferable as the present embodiments are given below.

(A) A structure including: an outer joint member in which three straight track grooves that extend in an axial direction are formed in an inner peripheral surface thereof; a tripod member as an inner joint member having three leg shafts protruding in a radial direction; and rollers as rolling elements rotatably supported on the leg shafts of the tripod member, wherein the rollers are arranged to be rollable along the track grooves of the outer joint member.

(B) A structure including: an outer joint member in which a plurality of straight track grooves that extend in an axial direction are formed in a cylindrical inner peripheral surface thereof; an inner joint member in which a plurality of straight track grooves paired with the track grooves of the outer joint member are formed in a spherical outer peripheral surface thereof; (3 to 8) balls as rolling elements disposed between the track grooves of the outer joint member and the track grooves of the inner joint member; and a cage holding the balls between the outer joint member and the inner joint member.

Figure 2:
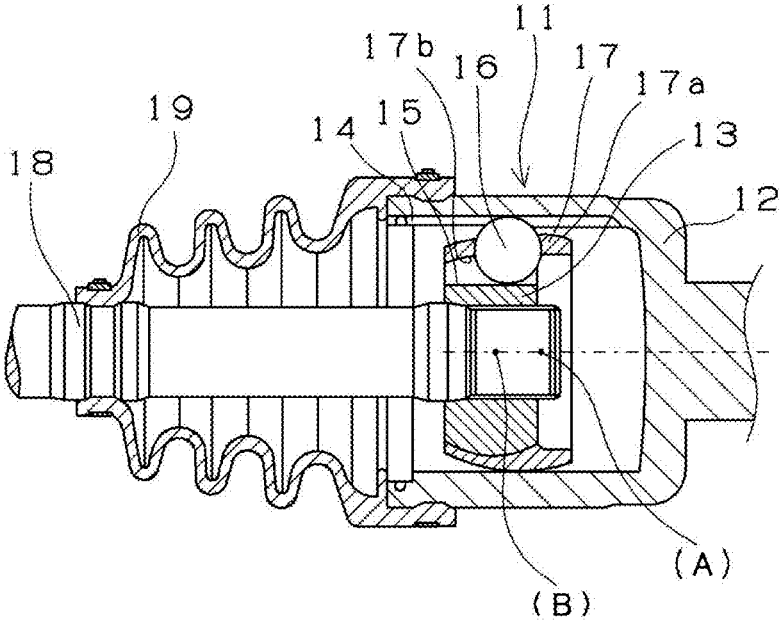
FIG. 2 is a diagram of a double-offset joint using the grease composition for a constant-velocity joint of the present invention in which a part thereof is cut out.

First and second specific embodiments of the constant-velocity universal joint of the present invention will be described based on FIG. 1 and FIG. 2. FIG. 1 shows a partially-cut sectional view of a tripod joint (hereinafter, referred to as TJ) and FIG. 2 shows a partially-cut sectional view of a double-offset joint (hereinafter, referred to as DOJ). These are sliding constant-velocity universal joints and are used for drive shaft for automobiles and the like.

As shown in FIG. 1, a TJ 1 includes three straight track grooves 3 formed in an axial direction in an inner surface of an outer joint member 2. A tripod member (inner joint member) 4 incorporated inside the outer joint member 2 is provided with three leg shafts 5. A spherical roller 6 is inserted on an outer side of each leg shaft 5, and a needle 7 is incorporated between the spherical roller 6 and the leg shaft 5 to support the spherical roller 6 such that the spherical roller 6 is rotatable and slidable in the axial direction. The spherical roller 6 is rollably inserted in the above-described track groove 3. A boot 9 is mounted from the outer joint member 2 over a shaft 8 joined to the tripod member 4.

The boot 9 includes an outer tubular end portion (large-diameter attachment portion) 9*a* which is fitted and fixed onto the outer joint member 2, an inner tubular end portion (small-diameter attachment portion) 9*b* which is fitted and fixed onto the shaft 8 coupled to the inner joint member 4, and a bellows-shaped bent portion (hereinafter also referred to as "bellows portion") 9*c* which connects the outer tubular end portion 9*a* and the inner tubular end portion 9*b* and has a plurality of mountains and valleys, and covers the constant-velocity universal joint in a sealing manner. This sealed space is hermetically filled with the grease as a lubricant. The boot 9 is such that the outer tubular end portion 9*a* is fitted onto the outer joint member 2 and fixed with a fastening band 10*a* or the like, and the inner tubular end portion 9*b* is fixed onto the shaft 8 with a fastening band 10*b* or the like. A boot groove 8*a* is formed in an outer peripheral surface where the inner tubular end portion 9*b* of the shaft 8 is fixed, and the inner tubular end portion 9*b* is fitted into the boot groove 8*a*. Note that by providing annular protruding portions 8*b* on both sides of the boot groove 8*a*, the fixation of the inner tubular end portion 9*b*, which is fitted in the boot groove 8*a*, to the shaft 8 can be further strengthened.

As shown in FIG. 2, a DOJ 11 includes a plurality of straight track grooves 14, 15 formed in an axial direction in an inner surface of an outer joint member 12 and an outer surface of an inner race (inner joint member) 13. A ball 16 incorporated between the track grooves 14, 15 is supported with a cage 17, and an outer periphery of this cage 17 is formed into a spherical surface 17*a* and an inner periphery thereof is formed into a spherical surface 17*b* that matches an outer periphery of the inner race 13. The centers (A) and (B) of the respective spherical surfaces 17*a*, 17*b* are displaced in the axial direction on the axis of the outer joint member 12. A boot 19 is mounted from the outer joint member 12 over a shaft 18 joined to the inner race 13. The structure of the boot 19 and the attachment structure thereof are the same as those of the boot 9 in FIG. 1. In addition, the space sealed by the boot 19 is hermetically filled with the grease as a lubricant.

The constant-velocity universal joint used for a drive shaft for automobiles, that is hermetically filled with the grease of the present embodiment, can maintain an excellent durability at a high temperature.

Therefore, various constant-velocity joints hermetically filled with the above-described grease composition, particularly plunging constant-velocity joints, are also encompassed within the scope of the present invention.

EXAMPLES

Grease compositions of Examples and Comparative Examples were prepared by using components described below. Specifically, 1 mol of 4',4-diphenylmethane diisocyanate and 2 mol of a certain amine were reacted in a base oil, and the temperature was increased and cooled, then followed by kneading with a three roll mill to obtain a base grease. To the base grease, additives were blended in ratios shown in Table 1 (the numbers in Table are % by mass based on the total mass of the composition), and the base oil is further added to obtain the amounts of the thickener in ratios shown in Table 1, followed by dispersing with a three roll mill to obtain the grease compositions of Examples and Comparative Examples. Note that the penetrations were measured and all adjusted to 325 in accordance with JIS K2220 7.

<(a) Base Oil>

Mineral oil

<(b) Thickener>

For the aliphatic diurea, octylamine was used as an amine.

For the alicyclic aliphatic diurea, cyclohexylamine and octadecylamine were used in a molar ratio of cyclohexylamine:octadecylamine=2:8 as amines.

For the alicyclic aromatic diurea, cyclohexylamine and aniline were used in a molar ratio of cyclohexylamine: aniline=7:3 as amines.

<Additives>

(c) ZnDTP: a zinc dialkyldithiophosphate (LUBRIZOL 1395, produced by Lubrizol)

(d) MoDTC (non-oil-soluble): a molybdenum dialkyl dithiocarbamate (ADEKA SAKURA-LUBE 600, produced by ADEKA)

(e) MoDTC (oil-soluble): a molybdenum dialkyl dithiocarbamate (ADEKA SAKURA-LUBE 525, produced by ADEKA)

(f) ZnDTC: a zinc dialkyldithiocarbamate (Vanlube AZ, produced by Vanderbilt)

(g) A benzothiazole-thione derivative (Vanlube 601, produced by Vanderbilt)

Test Methods

Each grease composition of Examples and Comparative Examples was tested by methods described below. Results are shown in Table 1.

<Roll Stability Test> (in Compliance with ASTM D 1831)

This test is a test for evaluating how easily the grease is softened by shear.

Test Conditions

Ambient temperature: 100° C.

Roll rotation speed: 165 rpm

Rotation time: 24 h

Evaluation Criteria

Worked penetration of the grease after the test

○: 400 or more x: less than 400

<SRV Test-Evaluation of Initial Conformability> (in Compliance with ASTM D5706)

This test is a test for evaluating the degree of smoothing of plate surface roughness after the test.

Test Conditions:

Surface pressure: 2.8 GPa

Sliding speed: 20 mm/s (3.0 mm×3.3 Hz)

Plate temperature: 95° C.

Ball diameter: 17.5 mm

Plate roughness Ra before the test: 0.7 μm

Evaluation Criteria

Plate roughness Ra after the test

○: less than 0.35 μm x: 0.35 μm or more

<Evaluation of Durability at a High Temperature>

Each grease composition of Examples and Comparative Examples was put into an actual tripod CVJ, and a joint durability test was conducted by using this under conditions described below, and the durability at a high temperature was evaluated by measuring the time when flaking occurred.

Test Conditions

Rotation speed: 200 rpm

Torque: 800 Nm

Angle: 6°

Temperature of the surface of the joint: 90 to 100° C.

Evaluation Method

The joint was dismantled and checked every 50 hours after the start of the test, and the time when the flaking area in the outer race, the inner race, or the trunnion or the needle reached 20 $mm^2$ was measured. Note that after the flaking area exceeds 20 $mm^2$, the operation becomes difficult to continue.

Evaluation Criteria

○: 250 h or more x: less than 250 h

<Evaluation of Induced Thrust-Vibration Resistance>

Each grease composition of Examples and Comparative Examples was put into an actual tripod CVJ, and vibration resistance was evaluated by using this CVJ and measuring the force generated in the axial direction as an induced thrust when this CVJ was rotated at an operating angle and torque.

Measurement Conditions

Rotation speed: 150 rpm

Torque: 300 Nm

Angle: 0 to 12 deg

Evaluation Criteria

Third-order component

○: 110 $N_{rms}$ or less

X: more than 110 $N_{rms}$

TABLE 1

| | | | Ex. 1 | Ex. 2 | Ex. 3 | Ex. 4 | Ex. 5 | Ex. 6 |
|---|---|---|---|---|---|---|---|---|
| (a) | Base oil | Amount | Bal. | Bal. | Bal. | Bal. | Bal. | Bal. |
| | | Kinematic viscosity at 100° C. [$mm^2/s$] | 16.1 | 19.4 | 21.6 | 16.1 | 19.4 | 21.6 |
| | | Viscosity index | 98 | 102 | 103 | 98 | 102 | 103 |
| (b) | Thickener | Aliphatic diurea | 6.0 | 6.0 | | | | |
| | | Alicyclic aliphatic diurea | | | 6.0 | 6.0 | 6.0 | 6.0 |
| | | Alicyclic aromatic diurea | | | | | | |
| (c) | ZnDTP | | 1.0 | 1.0 | 1.0 | 1.0 | 1.0 | 1.0 |
| (d) | Non-oil-soluble MoDTC | | 0.75 | 0.75 | 0.75 | 0.75 | 0.75 | 0.75 |

TABLE 1-continued

| | | | | | | | | |
|---|---|---|---|---|---|---|---|---|
| (e) | Oil-soluble MoDTC | | 1.0 | 1.0 | 1.0 | 1.0 | 1.0 | 1.0 |
| (f) | ZnDTC | | 3.0 | 3.0 | 3.0 | 3.0 | 3.0 | 3.0 |
| (g) | Benzothiazole-thione or a derivative thereof | | 0.6 | 0.6 | 0.6 | 0.6 | 0.6 | 0.6 |
| Roll stability test 100° C. × 24 h | | | 400 | 400 | 400 | 400 | 400 | 400 |
| Plate roughness Ra after SRV test μm | | | ○ | ○ | ○ | ○ | ○ | ○ |
| Anti-flaking properties | Constant-velocity joint | High temperture | ○ | ○ | ○ | ○ | ○ | ○ |
| | | | 250 | 350 | 400 | 250 | 350 | 400 |
| | | Ordinary temperature | ○ | ○ | ○ | ○ | ○ | ○ |
| | | | 800 | >1000 | >1000 | 800 | >1000 | >1000 |
| Inducced thrust | | Ordinary temperature | ○ | ○ | Δ | ○ | ○ | Δ |

| | | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| (a) | Base oil | Amount | Bal. | Bal. | Bal. | Bal. | Bal. | Bal. |
| | | Kinematic viscosity at 100° C. [$mm^2/s$] | 13.5 | 13.5 | 13.5 | 13.5 | 21.6 | 13.5 |
| | | Viscosity index | 80 | 96 | 80 | 96 | 82 | 80 |
| (b) | Thickener | Aliphatic diurea | 6.0 | 6.0 | | | | |
| | | Alicyclic aliphatic diurea | | | 6.0 | 6.0 | 6.0 | |
| | | Alicyclic aromatic diurea | | | | | | 13.0 |
| (c) | ZnDTP | | 1.0 | 1.0 | 1.0 | 1.0 | 1.0 | 1.0 |
| (d) | Non-oil-soluble MoDTC | | 0.75 | 0.75 | 0.75 | 0.75 | 0.75 | 0.75 |
| (e) | Oil-soluble MoDTC | | 1.0 | 1.0 | 1.0 | 1.0 | 1.0 | 1.0 |
| (f) | ZnDTC | | 3.0 | 3.0 | 3.0 | 3.0 | 3.0 | 3.0 |
| (g) | Benzothiazole-thione or a derivative thereof | | 0.6 | 0.6 | 0.6 | 0.6 | 0.6 | 0.6 |
| Roll stability test 100° C. × 24 h | | | 400 | 400 | 400 | 400 | 400 | 340 |
| Plate roughness Ra after SRV test μm | | | ○ | ○ | ○ | ○ | ○ | ○ |
| Anti-flaking properties | Constant-velocity joint | High temperture | x | x | x | x | ○ | x |
| | | | 150 | 150 | 150 | 150 | 350 | 50 |
| | | Ordinary temperature | Δ | Δ | Δ | Δ | | |
| | | | 600 | 600 | 600 | 600 | | |
| Inducced thrust | | Ordinary temperature | ○ | ○ | ○ | ○ | x | x |

| | | | Comp. Ex. 7 | Comp. Ex. 8 | Comp. Ex. 9 | Comp. Ex. 10 | Comp. Ex. 11 | Comp. Ex. 12 | Comp. Ex. 13 | Comp. Ex. 14 | Comp. Ex. 15 | Comp. Ex. 16 | Comp. Ex. 17 |
|---|---|---|---|---|---|---|---|---|---|---|---|---|---|
| (a) | Base oil | Amount | Bal. | Bal. | Bal. | Bal. | Bal. | Bal. | Bal. | Bal. | Bal. | Bal. | Bal. |
| | | Kinematic viscosity at 100° C. [$mm^2/s$] | 13.5 | 16.1 | 19.4 | 21.6 | 16.1 | 16.1 | 16.1 | 16.1 | 13.2 | 13.2 | 13.2 |
| | | Viscosity index | 96 | 98 | 102 | 103 | 98 | 98 | 98 | 98 | | | |
| (b) | Thickener | Aliphatic diurea | | | | | | | | | 5.0 | 5.0 | 5.0 |
| | | Alicyclic aliphatic diurea | | | | | 6.0 | 6.0 | 6.0 | 6.0 | | | |
| | | Alicyclic aromatic diurea | 13.0 | 13.0 | 13.0 | 13.0 | | | | | | | |
| (c) | ZnDTP | | 1.0 | 1.0 | 1.0 | 1.0 | | 1.0 | 1.0 | 1.0 | 1.0 | 1.0 | 1.0 |
| (d) | Non-oil-soluble MoDTC | | 0.75 | 0.75 | 0.75 | 0.75 | 0.75 | | 0.75 | 0.75 | 0.5 | 0.5 | 0.75 |
| (e) | Oil-soluble MoDTC | | 1.0 | 1.0 | 1.0 | 1.0 | 1.0 | | 1.0 | 1.0 | 0.5 | 0.5 | 1.25 |
| (f) | ZnDTC | | 3.0 | 3.0 | 3.0 | 3.0 | 3.0 | 3.0 | | 3.0 | 1.0 | 2.0 | 1.0 |
| (g) | Benzothiazole-thione or a derivative thereof | | 0.6 | 0.6 | 0.6 | 0.6 | 0.6 | 0.6 | 0.6 | | 1.0 | 1.0 | 1.0 |
| Roll stability test 100° C. × 24 h | | | 340 | 340 | 340 | 340 | 400 | 400 | 400 | 400 | 425 | 425 | 425 |
| Plate roughness Ra after SRV test μm | | | ○ | ○ | ○ | ○ | x | x | x | x | x | x | x |

TABLE 1-continued

| | | | | | | | | | | | | | |
|---|---|---|---|---|---|---|---|---|---|---|---|---|---|
| Anti-flaking properties | Constant-velocity joint | High temperture | x 100 | x 100 | x 100 | x 100 | x 100 | x 50 | x 50 | x 100 | x 50 | x 100 | x 100 |
| | | Ordinary temperature | | ○ >1000 | | | | | | | | | |
| Inducced thrust | | Ordinary temperature | x | x | x | | x | x | ○ | ○ | | | |

REFERENCE SIGNS LIST

1 TJ
2 outer joint member
3 track groove
4 tripod member (inner joint member)
5 leg shaft
6 spherical roller
7 needle
8 shaft
9 boot
10*a*, 10*b* fastening band
11 DOJ
12 outer joint member
13 inner race (inner joint member)
14, 15 track groove
16 ball
17 cage
18 shaft
19 boot

What is claimed is:

1. A grease composition for a constant-velocity joint, comprising:

(a) a base oil having a kinematic viscosity of 16.0 $mm^2/s$ or more at 100° C. and a viscosity index of 90 or more;

(b) a diurea-based thickener represented by the following formula (1)

$$R^1NH—CO—NH—C_6H_4—p\text{-}CH_2—C_6H_4—p\text{-}NH—CO—NHR^{1'} \quad (1)$$

wherein $R^1$ and $R^{1'}$ are each independently an octyl group, a dodecyl group, a hexadecyl group, an octadecyl group, or a cyclohexyl group;

(c) 0.2 to 2.0% by mass of a zinc dialkyldithiophosphate;

(d) 0.5 to 2.0% by mass of a non-oil-soluble molybdenum dialkyl dithiocarbamate;

(e) 0.5 to 3.0% by mass of an oil-soluble molybdenum dialkyl dithiocarbamate;

(f) 1.0 to 4.0% by mass of a zinc dialkyldithiocarbamate; and (g) 0.1 to 1.5% by mass of a benzothiazole-thione or a derivative thereof, wherein a mass ratio between the component (f) and the component (g) is (f):(g)=8:1 to 3:1.

2. The grease composition according to claim 1, wherein the component (c) is represented by the following formula (2):

$$[(R^2O)_2SP—S]_2—Zn \quad (2)$$

wherein $R^2$ is a primary or secondary alkyl group having 1 to 24 carbon atoms.

3. The grease composition according to claim 1, wherein the component (d) is represented by the following formula (3):

$$[R^{30}{}_2N—CS—S]_2—Mo_2O_mS_n \quad (3)$$

wherein $R^{30}$ is a primary or secondary alkyl group having 1 to 4 carbon atoms, m is 0 to 3, n is 1 to 4, and m+n=4.

4. The grease composition according to claim 1, wherein the component (e) is represented by the following formula (4):

$$[R^{31}{}_2N—CS—S]_2—Mo_2O_mS_n \quad (4)$$

wherein $R^{31}$ is a primary or secondary alkyl group having 5 to 24 carbon atoms, m is 0 to 3, n is 1 to 4, and m+n=4.

5. The grease composition according to claim 1, wherein the component (f) is represented by the following formula (5):

$$[R^4{}_2N—CS—S]_2—Zn \quad (5)$$

wherein $R^4$ is a primary or secondary alkyl group having 1 to 24 carbon atoms.

6. A constant-velocity joint hermetically filled with the grease composition for a constant-velocity joint according to claim 1.

* * * * *